US005807816A

United States Patent [19]

Cottrell et al.

[11] Patent Number: 5,807,816

[45] Date of Patent: Sep. 15, 1998

[54] LIGHT DUTY CLEANING COMPOSITION

[75] Inventors: John Stuart Cottrell, Cheshire; George Kerr Rennie, Bebington, Wirral, both of United Kingdom

[73] Assignee: Lever Brothers Company, Division of Conopco, Inc., New York, N.Y.

[21] Appl. No.: 645,012

[22] Filed: May 9, 1996

[30] Foreign Application Priority Data

May 10, 1995 [GB] United Kingdom ..... 9509452

[51] Int. Cl.[6] ..... C11D 00/00; C11D 17/00

[52] U.S. Cl. ..... 510/235; 510/237; 510/426; 510/428

[58] Field of Search ..... 510/235, 237, 510/426, 428

[56] References Cited

U.S. PATENT DOCUMENTS 4,663,069 5/1987 Llenado ..... 252/117

FOREIGN PATENT DOCUMENTS 0 070 074 1/1983 European Pat. Off. .
0 092 877 11/1983 European Pat. Off. .
0 341 071 11/1989 European Pat. Off. .
0 387 063 9/1990 European Pat. Off. .
0 444 267 9/1991 European Pat. Off. .
0 486 786 5/1992 European Pat. Off. .
0 570 619 11/1993 European Pat. Off. .
0 682 103 11/1995 European Pat. Off. .
42 34 487 10/1992 Germany .
WO 86/02943 5/1986 WIPO .
WO 90/05772 5/1990 WIPO .
WO 91/11506 8/1991 WIPO .
WO 93/23512 11/1993 WIPO .
WO 93/23513 11/1993 WIPO .
WO 94/09102 4/1994 WIPO .
WO 94/22998 10/1994 WIPO .
WO 95/30729 11/1995 WIPO .
WO 95/33036 12/1995 WIPO .

OTHER PUBLICATIONS

Seifen, Oele, Fette, Wasche, vol. 121, No. 6, May 2, 1995; pp. 412,414,416,418,419; C. Nieendick et al.; "Alkyl Polyglycosides A new Generation of Surfactants for the use in Manual Dishwashing Agents".

*Primary Examiner*—Mukund J. Shah
*Assistant Examiner*—Deepak R. Rao
*Attorney, Agent, or Firm*—A. Kate Huffman

[57] ABSTRACT

Improved light duty cleaning compositions comprising 15–50% surfactant on product can be formulated such that they comprise, on surfactant:

a) 50–70% wt of a mixture of primary alkyl sulphate and alkyl ether sulphate, wherein the average ethoxylation value of the mixture is 0.5–2.5, b) 2–8% wt of a betaine, an amine oxide or a mixture of betaine and amine oxide, and, c) 25–45% wt of an alkylpolyglucoside surfactant.

It is believed that compositions which have an excess in surfactant of a mixture of both primary alkyl sulphate and alkyl ether sulphate in a specified ratio, i.e. such that the total EO is 0.5–2.5, together with a lesser, but significant level of APG and a minor amount of betaine, provide an acceptable combination of mildness, cleaning and foaming under a broad range of conditions and show surprising benefit in a bowl-wash situation.

8 Claims, 1 Drawing Sheet

LIGHT DUTY CLEANING COMPOSITION

TECHNICAL FILED

The present invention relates to light duty cleaning compositions which comprise alkyl polyglycoside (APG) surfactants. More specifically, the invention relates to, but is not limited to, liquid 'dishwash' compositions suitable for cleaning hard surfaces such as plates, other crockery, kitchen utensils and the like.

BACKGROUND TO THE INVENTION

Commercial hand dishwashing compositions typically comprise, as the principal surfactant, one or more surfactants selected from a relatively small group of materials. In particular, principal surfactants are typically selected from amongst primary alcohol sulphates, secondary alkane sulphonates, linear alkyl benzene sulphonate, ethoxylated alcohols and alkyl ether sulphates.

In addition to these principal surfactants it is commonplace for compositions to comprise a so called 'foam-booster', selected from amine oxides, alkanolamides (particularly the mono and diethanolamides and isopropanolamides) and other nitrogen-based surfactant compounds, including poly-hydroxy amides and betaines.

Compositions also comprise hydrotropes to control solubility of the non aqueous components and/or viscosity, stability or clarity of the products. Known hydrotropes include lower aliphatic alcohols, especially ethanol; urea; lower alkylbenzene sulphonates such sodium toluene or xylene sulphonate; and combinations of these. It is preferred that hydrotropes should be used in the minimum possible quantities consistent with good formulation properties over a wide temperature range.

Many compositions are known which make use, as the principal surfactant, of ethoxylated alcohol nonionic surfactants of the general formula:

$$R—O—(CH_2—CH_2O)_n—H$$

where R is alkyl and n is typically 5–14, or the related alkyl ether sulphates of the general formula:

$$R—O—(CH_2—CH_2O)_n—SO_3^-$$

where R is again alkyl and n is typically 1–5.

In typical commercial formulations, some 80% of the surfactant system comprises the ethoxylated alcohols and/or ether sulphates, with the balance of the actives comprising one or more foam-boosters. Foam boosters are often selected from betaines and amine oxides. The overall active concentration on product typically varies from around 20% for 'economy' brands to around 40% for 'concentrated' products.

It is known that the nonionic alkylpolyglycoside (APG) surfactants find a variety of applications, including light duty cleaning compositions suitable for hand dishwashing.

WO 91/11506 relates to hand dishwashing compositions which comprise, on surfactant:

a) >45% wt of a primary alkyl sulphate (PAS) and alcohol ether sulphate (AES) mixture having a ratio of PAS: AES of at least 2:1, b) betaine in a weight ratio of a:b of at least 1.5:1, and c) APG.

The compositions which are disclosed in this specification generally comprise mixtures of at least 80% wt PAS+AES, together with around 10% wt betaine and 10% wt APG.

WO 94/16042 relates, in one aspect, to hand dishwashing compositions which comprise, on product;

a) 16–18% PAS, b) 2–4% betaine, c) 8–10% APG,

The compositions disclosed in this specification include mixtures of PAS (as sodium lauryl sulphate), APG and cocoamidopropyl betaine. The PAS does not contain any ethoxylated material: this is consistent with the view that the APG replaces the AES.

A known problem in the field of hand dishwashing is to maintain an acceptable combination of mildness, cleaning and foaming. Each of these is a important consumer perceived property of cleaning compositions and the properties are interlinked such that improving one parameter by modifying the composition will often reduce another parameter to an unacceptable level. There is therefore a technical problem to find regions of effective formulation within the overall formulation space of APG containing dishwash liquids.

BRIEF DESCRIPTION OF THE INVENTION

We have determined that improved light duty cleaning compositions comprising 15–50% surfactant on product can be formulated such that they comprise, on surfactant:

a) 50–70% wt of a mixture of primary alkyl sulphate and alkyl ether sulphate, wherein the average ethoxylation value of the mixture is 0.5–2.5, b) 2–8% wt of a betaine, an amine oxide or a mixture of betaine and amine oxide, and, c) 25–45% wt of an alkylpolyglucoside surfactant.

It is believed that compositions which have an excess in surfactant of a mixture of both primary alkyl sulphate and alkyl ether sulphate in a specified ratio, i.e. such that the total EO is 0.5–2.5, together with a lesser, but significant level of APG and a minor amount of betaine, provide an acceptable combination of mildness, cleaning and foaming under a broad range of conditions and show surprising benefit in a bowl-wash situation.

The invention also relates to a method of light duty cleaning which comprises the step of contacting the surfaces to be cleaned with an aqueous composition comprising a 0.2–0.001% solution of a mixture of surfactants which comprise:

a) 50–70% wt of a mixture of primary alkyl sulphate and alkyl ether sulphate, wherein the average ethoxylation value of the mixture is 0.5–2.5, b) 2–8% wt of a betaine, an amine oxide or a mixture of betaine and amine oxide, and, c) 25–45% wt of an alkylpolyglucoside surfactant.

The invention also relates to a method of light duty cleaning which comprises the step of contacting the surfaces to be cleaned with an aqueous composition comprising a 50-1% solution of a mixture of surfactants which comprise:

a) 50–70% wt of a mixture of primary alkyl sulphate and alkyl ether sulphate, wherein the average ethoxylation value of the mixture is 0.5–2.5, b) 2–8% wt of a betaine, an amine oxide or a mixture of betaine and amine oxide, and, c) 25–45% wt of an alkylpolyglucoside surfactant.

DETAILED DESCRIPTION OF THE INVENTION

Anionics

Figure 1:
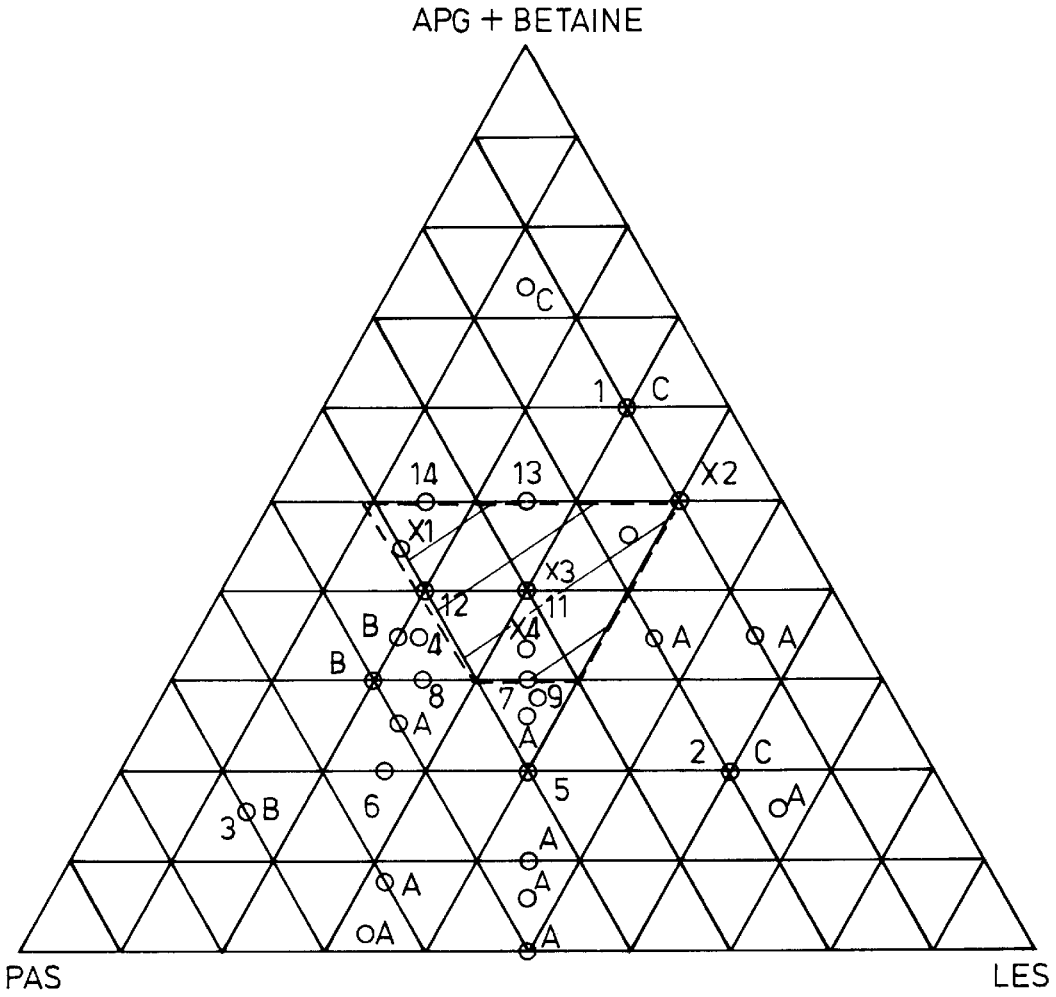
FIG. 1 is a diagram of the 'Zein Solubility Test' results for selected surfactants.

The two anionic surfactants, primary alkyl sulphate and alkyl ether sulphate are believed to be essential components of the invention.

Typically, the mixture of primary alkyl sulphate and alkyl ether sulphate comprises:

(1) 5–45% wt on total surfactant of primary alkyl sulphate comprising essentially no ethoxylated material, and (2) 5–40% wt on total surfactant of a mixture of primary alkyl sulphate and ethoxylated primary alkyl sulphate, the ratio of ethoxylated to non-ethoxylated primary alkyl sulphate in (2) being such that the overall ratio of ethoxylated to non-ethoxylated primary alkyl sulphate (AES) in (1)+(2) is 0.5–2.5.

It is believed that the above constraint can be met by using primary alkyl sulphate (PAS) as (1) and technical grade PAS-3EO as (2). It is known that materials such as technical grade ethoxylated PAS with low ethoxylation numbers comprise significant levels of unethoxylated PAS, i.e. a material equivalent to (1). It is believed that PAS-1EO can replace both (1) and (2) and therefore comprise substantially all of (a) in the above-mentioned description of the invention.

Preferred levels of the mixture of PAS and AES are such that the mixture comprises equal weights of the two components, preferably each present as 30–40% of the total surfactant present. In particularly preferred embodiments of the invention the average ethoxylation value of the mixture of primary alkyl sulphate and alkyl ether sulphate is 0.75–1.25 EO. The preferred average ethoxylation level in the alkyl ether sulphate component taken alone is 2–4 EO.

The alkyl chain length of the PAS falls in the range $C_8$–$C_{16}$. Preferably the PAS has a $C_{12}$–$C_{13}$ average alkyl chain length. Preferably the PAS is substantially linear. Suitable materials include DOBANOL-23S (RTM, ex. SHELL).

Preferably the alkyl ether sulphates are materials of the general formula:

$$R_1—(OCH_2CH_2)_m—SO_3^-$$

wherein $R_1$ is linear or branched, $C_8$ to $C_{18}$ alkyl. More preferably the alkyl chain length of the AES falls in the range $C_8$–$C_{16}$. Preferably the AES has a $C_{12}$–$C_{13}$ average alkyl chain length. Preferably the AES is substantially linear. Suitable materials include DOBANOL-23-3S (RTM, ex SHELL).

Betaines and/or Amine Oxides

Betaines and/or amine oxides are believed to be essential components of the invention. Betaines are preferred to amine oxides.

The preferred level of betaine in the compositions according to the invention is around 5% wt on surfactant. Amidobetaines are particularly preferred.

Preferred amido betaines are propyl amido betaines of the general formula:

$$R.CONH.CH_2.CH_2.CH_2.N^+(R_6R_7).CH_2COO^-$$

wherein

R is straight or branched $C_8$ to $C_{18}$ alkyl, $R_6$ is $C_1$ to $C_3$ alkyl or $C_1$ to $C_3$ hydroxyalkyl, and $R_7$ is $C_1$ to $C_3$ alkyl or $C_1$ to $C_3$ hydroxyalkyl;

Preferably, the betaine has an alkyl chain length (R) of $C_{12}$–$C_{14}$.

Suitable materials include TEGO BETAINE L551 (RTM ex. GOLDSCHMIDT).

Alkylpolyglucoside

APG is believed to be an essential component of the invention. Preferred levels of APG are such that the composition comprises 30–40% wt of APG on total surfactant.

Preferred APG's have an alkyl chain comprising $C_{12-16}$ and it is preferred that more than 50% wt of the APG present in the compositions of the invention comprises a $C_{12-14}$ alkyl APG and that the majority of the remaining APG is $C_8$–$C_{18}$. The preferred degree of polymerisation is 1.1–1.6, more preferably 1.3–1.5. Suitable materials include GLUCOPON 600 (RTM ex HENKEL).

It is believed that APG's with average alkyl chain lengths in the range C12–C16 show rapid fat removal. The APG preferably consists predominantly of material with alkyl chain lengths C12–C14 and DP 1.3–1.5 as these are believed to show the most rapid fat removal from surfaces.

Optional components in compositions of the present invention include nonionic surfactants other than APG. It is believed that small amounts of such nonionics can replace a portion of the APG. Suitable surfactants include ethoxylated alcohols, sugar-amide derivatives, sugar-ester derivatives and sugar-ethers other than APG. It is preferred, that compositions of the invention are free of alcohol ethoxylate.

Hydrotropes are optional components, although we have determined, surprisingly, that for compositions comprising up to 25% wt of surfactant, hydrotropes are not required to achieve a pourable product. It is believed that the combination of surfactants described above renders the presence of expensive hydrotropes unnecessary or enables the levels of these hydrotropes to be reduced.

Accordingly, it is preferred that the level of hydrotrope is no more than 20% of the total surfactant content on product. e.g. for a product containing 20% surfactant, the hydrotrope level should preferably be less than 4% on product. Where hydrotropes are required they are preferably selected from conventional hydrotrope materials including one or more of lower alkanols, alkaryl sulphonates, including xylene sulphonates and/or ureas. Higher levels of hydrotrope are required if the surfactant actives present are of low quality.

The viscosity of compositions according to the invention is preferably in the range 200–300 cP at a shear rate of 21 reciprocal seconds as measured at a temperature of 25 Celcius using a Haake MV cup and bob.

Magnesium is an optional component of the formulations according to the present invention. It is believed that the presence of magnesium boosts the detergency of the anionic surfactants present in the formulation. Preferred magnesium levels are equivalent to 2–14% as $MgSO_4.7H_2O$. Magnesium may be present as the counter ion for the surfactant or be added.

Preferably, other electrolytes can be present at levels of 0.1–5% by weight of the overall composition. Particularly preferred amongst the electrolytes are alkali metal halides, carbonates, bicarbonates and sulphates of these, the most preferred electrolyte is sodium chloride. Sodium chloride is conveniently present at a level of 0.1– 5%, as a viscosity modifier. Ammonium salts may be present. The preferred electrolyes for grease removal are magnesium and potassium.

Among other, inessential, ingredients which may also be used in compositions according to the present invention are opacifiers (e.g. ethylene glycol distearate), thickeners (e.g., guar gum), antibacterial agents (e.g. formaldehyde or Bronapol™), anti-tarnish agents, weak metal chelators (e.g. citrates, glycinates), perfumes, abrasives (e.g. calcites and dolomites) and dyes. When magnesium is present, the use of strong metal chelating agents with a high affinity for magnesium is discouraged as these will reduce the benefits associated with the presence of magnesium.

Compositions according to the present invention can further comprise a solvent, preferably, when present, at level of 1–15% wt on product, more preferably at a level of 2–7% on product.

Preferably, any solvent present is selected from: propylene glycol mono n-butyl ether, dipropylene glycol mono n-butyl ether, propylene glycol mono t-butyl ether, dipropylene glycol mono t-butyl ether, diethylene glycol hexyl ether, ethyl acetate, methanol, ethanol, isopropyl alcohol, ethylene glycol monobutyl ether, di-ethylene glycol monobutyl ether and mixtures thereof.

Most preferably the solvent is either a glycol ether or a $C_2$–$C_5$ alcohol solvent.

Particularly preferred solvents are selected from the group comprising ethanol (preferably as industrial methylated spirits), propylene glycol mono n-butyl ether (available as 'Dowanol PnB' [RTM]) and di-ethylene glycol monobutyl ether (available in the marketplace both as 'Butyl Digol' [RTM] or 'Butyl Carbitol' [RTM]).

A further inessential component is alkylene glycol, typically present at a level of 0–10% on product, irrespective of the overall surfactant concentration. Propylene glycol is particularly suitable as a hydrotrope and/or viscosity modifier and while it is typically present in hand dishwashing compositions known in the art it may be dispensed of in compositions according to the present invention.

Bearing the above in mind typical compositions according to the present invention comprise 10–50%, preferably 15–35% surfactant on product, which surfactant comprises, on total surfactant:

a) 30–40% wt PAS having a $C_{12-13}$ average alkyl chain length, b) 30–40% wt AES having a $C_{12-13}$ average alkyl chain length and an ethoxylation value of 2–4, c) 30–40% wt APG having a $C_{12-14}$ average alkyl chain and a degree of polymerisation of 1.2–1.5, and, d) 2–8% wt of an amido betaine having a $C_{12-14}$ average alkyl chain.

Preferred total compositions, as aqueous solutions, comprise:

a) 10–25% wt PAS/AES mixture, preferably sodium lauryl ether sulphate 1EO (MMW 339, $C_{12}$ 38–48%, $C_{13}$ 52–62%), b) 1–3% wt betaine, preferably lauryl amido propyl betaine (MMW 342, $C_{12}$ 95%), c) 9–13% APG based on a natural fatty alcohol ($C_{12}$–$C_{14}$) having a degree of polymerisation of 1.4 (GLUCAPON 600CS UP is a suitable material)

d) 2–10% wt ethanol, e) 1–3% wt sodium cumeme sulphonate or other anionic hydrotrope f) 0.1–0.5% wt polycarboxylyic acid, preferably citric acid, g) >1% dyes, antimicrobial agents (preferably including formaldehyde).

In order that the present invention may be further understood it will be described hereinafter by way of examples and with particular reference to the sole accompanying figure.

EXAMPLES

Example 1: Fat/Grease Removal

Compositions were prepared as given in Table 1 below

TABLE 1

| Component | Trade Name | wt % present on surfactant |
|---|---|---|
| PAS | DOBANOL 23S ™ | 30 |
| LES | DOBANOL 23-35 ™ | 30 |
| APC | GLUCAPON; 600 ™ | 35 |
| Betaine | TEGO BETAINE L5351 ™ | 5 |

*Or other APG as appropriate (see table 2 for details).

The compositions comprised 20% surfactant in water. Fat removal was determined in glass Petri dishes which were coated with fat ('Kilverts'™ lard) and the time taken to remove the fat under standard conditions (50 Celcius, 0.04% AD) was determined by the following method.

200 g of fat was weighed into a beaker and heated slowly to 50°±2° C. until melted. 0.4 g (0.2% w/w) of dye, eg FAT RED 7B, was transferred to the fat with stirring and temperature increase to 60°±2° C., continue: stirring until all the dye has dissolved (~30 minutes ). An alternative fat should be used if the fat available contains significant quantities of emulsifiers as the presence of these components will alter the results.

Each petri dish had a cross marked on it centrally using permanent ink. Petri dishes were placed in a clean oven at 45°±2° C. for 5 minutes, removed form oven and filled with 5 mls of the fat (still maintained at 60°±2° C.) ensuring uniform coverage. The dishes were left to cool at room temperature over a period of 1½–2 hours before use. 500 mls of test solution was prepared at the desired concentration (typically 0.04% AD, ie 1 gm/l$^t$ of a 40% AD concentrate) using water of a specific hardness (typically 5, 12 or 24 deg FH) and heated to 50° C. in a water bath. The hot test solution was poured into a large beaker (e.g. 2 L) containing a layer of glass beads (minimising the volume of foam produced) and placed back in the waterbath, the temperature being maintained at 50 C.

The test petri dish was added; time keeping was started as soon as the dish was submerged in the test solution. At the point at which the solution breaks through to the glass surface the time is recorded. The time at which the fat in each quadrant was fully removed was also recorded. While a tiny amount of small fatty speckles may be left on the dish: where these cover a negligible fraction of the base, they may be ignored.

The results given in table 2 below show that fat removal is fastest and fat dispersion good if predominantly $C_{12-16}$ APG of DP=1.4 is present. Table 2 below gives the fat removal times for a range of APG's of varying degree of polymerisation and alkyl chain length.

TABLE 2

| DP of APG | alkyl chain | time in seconds |
|---|---|---|
| 1.6 | 8–10 | (large droplets formed*) |
| 1.5 | 8–14 | 677 |
| 1.4 | 8–16 | 570 |
| 1.4 | 8–14 | 503 |
| 1.4 | 9–11 | 650 |
| 1.4 | 12–16 | 460 |
| 1.4 | 12–14 | 460 |

*in this instance the fat was not completely removed but formed large droplets.

From the results presented in Table 2 it can be seen that the APG with an alkyl chain length of 12–16 and a DP of around 1.4 gives the most rapid fat removal. Good results were also obtained with the APG of chain length 12–14.

Example 2: Fat/Grease Removal, Mildness and Foaming

Compositions were prepared by mixing, at room temperature, proportions of:

PAS: DOBANOL 23S™

LES: DOBANOL 23–3S™

APG: GLUCAPON 600™ in the presence of 5% wt on surfactant of TEGO BETAINE L5351 (Cocamidopropyl betaine 33%; ex Th. Goldschmidt Ltd., Ruislip, England). This betaine is believed to be: $C_{12}$=80%, $C_{14}$=35%, nominal @30% AD.

The proportions of these components present in the compositions are indicated in FIG. 1 and as shown in TABLEs 2a and 2b. These varying compositions were subjected to the following tests:

a) grease/fat removal, as described above, b) mildeness, c) foaming.

In the figure 'APG' indicates APG plus 0%, 5% or 10% of the betaine.

For mildness, the 'Zein Solubility Test' developed in 1964 by Gotte was used: this is described in Proc.IV Int. Congress Surface Active Subs., Brussels vol 3, p.83–90, 1964. In the tests used in the examples 5.0 gm zein (ex Kodak) is equilibrated with 40 gm of surfactant solution in a 4 oz bottle for one hour at 35 C. in a shaking bath before centrifuging and filtering through tissue to remove any solid zein. A known mass of supernatant is then weighed into a digestion tube and an analysis performed to determine nitrogen content of the sample using the Micro-Kjeldahl technique. Tests were conducted at 3% AD. Mildness is expressed as (100 - % zein dissolved) ie the greater this number then the more "mild" the surfactant mixture. Surfactants having a % Zein score of greater than around 40 (i.e. a mildness score of less than 58) are considered insufficiently mild.

For foaming, the mixtures described were assessed by measuring the foam performance using a modified Schlacter-Dierkes test which is based on the principle described in Fette und Seifen 1951, vol53 , page 207. A 100 ml aqueous solution of the dishwashing liquid at 0.04% AD in 24° H (ie 24 parts of calcium carbonate per 100.000 parts of water) at 45° C. is rapidly agitated using a vertically oscillating perforated disc within a graduated cylinder. After the initial generation of foam, increments (0.2 g) of soil (9.5 parts commercial cooking fat, 0.25 parts oleic acid, 0.25 parts stearic acid, dispersed in 120 parts water and the emulsion stabilised with 10 parts wheat starch) are added at 15 second intervals (comprising 10 seconds mild agitation and 5 seconds rest) until the foam collapses. The result is recorded as the number of soil increments (NSI score). The data is then normalised using a commercial product as standard=1.0.

FIG. 1 and TABLES 2a and 2b show the results of these tests. Compositions are indicated by the position on the graph and are scored as follows:

A: failed on criterion (a): the test composition takes longer than 600 secs to remove test fat.

B: failed on criterion (b): scores less than 58.

C: failed on criterion (c): scores less than 1.0.

D: Acceptable by criteria (a)–(c) above.

The compositions of the examples can be determined by the position of the markers on the graph. In a number of comparative tests against commercial formulations containing APG, the commercial formulations failed on criterion (a).

Samples were prepared with compositions as listed in TABLE 2a and their cleaning properties at bowlwash concentration determined. Compositions are expressed as wt % fraction of the total surfactant present. Grease removal as determined by the test described above is scored in seconds. Lather is expressed as a ratio relative to a 2:1 Dobs 102™ :Dobanol 23-3s™ mixture used as a standard. Lather scores of 1.2 and greater are considered satisfactory. Unsatisfactory results (comparative examples) are indicated by a "U". The code 'nd' indicates that an analysis was not done.

TABLE 2a

| Ex. No. | PAS | LES(3EO) | APG | TEGO L5351 | GREASE REMOVAL | LATHER |
|---|---|---|---|---|---|---|
| X1 | 36.7 | 18.3 | 40 | 5 | 479 | 1.3 |
| X2 | 10 | 40 | 45 | 5 | 574 | nd |
| X3 | 30 | 30 | 35 | 5 | 581 | 1.3 |
| X4 | 32.5 | 32.5 | 30 | 5 | 563 | nd |
| 1 | 10 | 30 | 55 | 5 | 652 U | 1.2 |
| 2 | 20 | 60 | 15 | 5 | 789 U | 1.2 |
| 3 | 70 | 15 | 10 | 5 | 527 | 1.3 |
| 4 | 43.3 | 21.9 | 30 | 5 | 494 | 1.3 |

The above tests were repeated without betaine and with 10% betaine. These results are presented in TABLE 2b below. These show that a foam booster such as betaine or amine oxide is required to get acceptable performances Table 2 also shows that doubling the level of foam booster to 10% does not give a proportionally improved formulation. The example numbers used in TABLEs 2a and 2b are used in FIG. 1.

TABLE 2b

| Ex. No. | PAS | LES(3EO) | APG | TEGO L5351 | GREASE REMOVAL |
|---|---|---|---|---|---|
| 5 | 40 | 40 | 20 | 0 | 826 U |
| 6 | 53.3 | 26.7 | 20 | 0 | 818 U |
| 7 | 35 | 35 | 30 | 0 | 819 U |
| 8 | 46.7 | 23.3 | 30 | 0 | 717 U |
| 9 | 35 | 35 | 20 | 10 | 588 |
| 10 | 46.7 | 23.3 | 20 | 10 | 563 |
| 11 | 30 | 30 | 30 | 10 | 550 |
| 12 | 40 | 20 | 30 | 10 | 491 |
| 13 | 25 | 25 | 40 | 10 | 607 U |
| 14 | 33.3 | 16.7 | 40 | 10 | 540 |

From the results in the TABLES and FIG. 1 it can be seen that compositions which comprise relatively large levels of LES are generally poor at removing grease (i.e. they fail on criterion 'a'). Compositions rich in PAS generally have poor mildness (fail on 'b') despite the presence of betaine. Compositions which contain relatively large levels of APG are relatively poor foamers (fail on 'c') and are also proportionally more expensive. Compositions according to the present invention fall within shaded region of the figure which is surrounded by the dashed line and are acceptable as regards grease removal, foaming and mildness.

Example 3: Comparative Examples

A composition was prepared as given in Table 3 below:

TABLE 3A

| formulation Y | |
|---|---|
| 10.85% wt | sodium lauryl ether sulphate 1EO (MMW 339, $C_{12}$ 38–48%, $C_{13}$ 52–62%) |
| 1.55% wt | lauryl amido propyl betaine (MMW 342, $C_{12}$ 95%) |
| 10.85% wt | GLUCAPON 600CS UP |
| 5.0% wt | Industrial methylated spirits |
| 1.50% wt | Sodium cumene sulphonate |
| 0.36% wt | Citric acid |
| >1% wt | dyes and fluorescers |
| >1% | formaldehyde |
| balance water | |

The product had a viscosity of 250 cP at a shear rate of 21 reciprocal seconds measured using a Haake viscometer Comparative were performed against products 'A' and 'C' all of which are commercially available in the UK. 'A' is a typical hand dishwash liquid based on anionic surfactant, amine oxide and a small quantity of glucamide. 'C' is similar to 'A' but contains more glucamide. Formulations are approximately as giving in Table 3B (all in weight %):

TABLE 3B

| | A | B |
|---|---|---|
| Alcohol Ethoxylate | 5.0 | 4.7 |
| Betaine | 0 | 1.3 |
| Alkyl ether sulphate (Mg) | 18 | 17.8 |
| Glucamide | 2.7 | 7.3 |
| Alkyl amine Oxide | 4.0 | 1.1 |

The following results were obtained in water of 5, 25 and 34 degrees French hardness.

Lather results are obtained using the modified Schlacter-Dierkes test as described above at 0.04% AD, using the fat-flour soil at a temperature of 45 Celcius and are the mean of 8 determinations using both two different commercial cooking fats. The results show that product 'Y' lathers as acceptably as a leading brand. The remaining lather results show the benefits of adding Mg and a foam booster (Lauryl monoethanolamide) to the formulations of the invention. It can be seen that the presence of Mg improves lathering.

TABLE 4

| | 5French 'A' | 5French 'Y' | 25French 'A' | 25French 'Y' |
|---|---|---|---|---|
| Lather | 36 | 35 | 41 | 38 |
| (+8% Mg) | — | 37 | — | 40 |
| (+1.5% LMEA) | — | 35 | — | 36 |

Dish washing results were determined using three tests. In each case the score is the number of plates washed before the foam is reduced to an unacceptable level.

All three tests use the same soil. This is prepared by mixing 2.5 gm (93%) stearic acid, 2.5 gm oleic acid and making up to 100 ml with corn oil. The mixture is heated to 70 Celcius. Separately, 100 gm rice starch is added to 200 gm demin water at 45 celcius to form a smooth paste. The oil is added to the rice starch mixture and this poured into 800 gm freshly boiled demin water, washin the remaining starch into the mixture with a further 200 ml of water. After cooling 5 ml samples of soil are spread evenly onto 22 cm diameter ceramic plates.

In 'Bowl-Wash' tests product is made up to 1 gm liter (i.e. 0.04% AD) in a washing solution at 45 Celcius. Foam is generated by dropping 4.5 liters of heated water through a funnel into 500 ml of concentrated product so as to generate the washing solution at the required AD. Plates are cleaned using a clean dry sponge (three cycles per side) while the plates are held resting on the base of the bowl at an angle of around 45 degrees. At the first break in foam (i.e. the point where the foam does not cover the surface) the number of plates washed is recorded.

In 'Dip and Wipe' tests soiled plates are used as in the Bowl-Wash tests except that 2 ml of soil is placed on each plate. Each soiled plate is aged for five minutes and rinsed with 7 ml of water. 50 gm of washing solution are prepared at 4% product in water. All of this product is adsorbed onto a sponge which is used to clean plates resting on the top of a stack of soiled plates (10 wipes on front surface, 4 on back) allowing excess solution to run onto the next plate. The end point is reached when foam remains on neither the stack or the sponge and the number of plates cleaned is recorded.

In 'Direct Application' tests 1 ml of soil is applied to each plate, aged for five minutes and rinsed with 10 ml of water. 2.5 ml of product is applied directly to a sponge previously soaked in 26 gm of water which is used to clean plates resting on the top of a stack of soiled plates (10 wipes on front surface, 4 on back) allowing excess solution to run onto the next plate. The end point is reached when foam remains on neither the stack or the sponge and the number of plates cleaned is recorded.

TABLE 5

| | 5French 'A' | 5French 'Y' | 34French 'A' | 34French 'Y' |
|---|---|---|---|---|
| Bowl Wash | 50 | 86 | 44 | 77 |
| Dip and Wipe | 29 | 29 | 29 | 31 |
| Direct Appln. | 48 | 44 | 52 | 53 |

Mildness was compared using the Zein test as described above. At 3% AD, Formulation Y, 'A' and 'C' both solubilised less than 40% of the Zein and consequently can be considered mild.

In the Petri dish test described in Example 1 above, but using a different fat, Formulation Y scored 481 whereas the 'A' scored 418. This shows no significant difference. The interfacial tension (against olive oil/13 French hard water) of Formulation Y was 0.57 whereas that of 'A' was 0.21. Score less than 1 are indicative of good grease removal performance.

These comparative examples show that the formulations of the invention exhibit acceptable properties as regards lathering, mildness, wash efficiency and grease removal. The compositions of the invention can be seen to exhibit very significantly improved properties as regards the 'bowl-washing' test.

Example 4: Examples with Magnesium

Magnesium improves performance of dishwashing compositions in soft water areas. The following examples (see table 6) show that the compositions of the invention due not suffer significant changes in viscosity or cloud point as magnesium salts are introduced. The formulation used was Formulation Y with the addition of Mg as indicated.

TABLE 6

| % $MgSO_4.7H_2O$ added | Viscosity (mPas) | Cloud Point (–Celcius) |
|---|---|---|
| 0 | 284 | 7 |
| 1 | 284 | 7 |
| 2 | 308 | 7 |
| 3 | 320 | 6 |
| 4 | 332 | 6 |
| 6 | 320 | 7 |
| 8 | 284 | 8 |
| 10 | 260 | 8 |
| 12 | 237 | 7 |
| 14 | 225 | 8 |

The experiment shown in Table 5 was repeated in the presence of 8% $MgSO_4.7H_2O$ to show that the compositions of the invention could be further improved by the addition of Mg. The results are presented in Table 7 below.

TABLE 7

| | 5French + Mg | 5French 'Y' | 34French + Mg | 34French 'Y' |
|---|---|---|---|---|
| Bowl Wash | 80 | 86 | 83 | 77 |
| Dip and Wipe | 33 | 29 | 34 | 31 |
| Direct Appln. | 59 | 44 | 64 | 53 |

We claim:

1. Light duty cleaning compositions comprising 15–50% wt surfactant on product, wherein said surfactant comprises:

a) 50–70% wt of a mixture of primary alkyl sulphate and alkyl ether sulphate, wherein the average ethoxylation value of the mixture is 0.5–2.5, the level of primary alky sulphate being 10–40% wt on surfactant and the level of alkyl ether sulphate being 10–40% wt on surfactant;

b) 2–8% wt of a betaine, an amine oxide or a mixture of betaine and amine oxide, and:

c) 25–45% wt of an alkylpolyglucoside surfactant, said alkyl surfactant having a degree of polymerization of 1.1–1.5.

2. Composition according to claim 1 wherein the primary alkyl sulphate and alkyl ether sulphate each comprise 30–40% wt of the total surfactant present.

3. Composition according to claim 1 wherein the average ethoxylation value of the mixture of primary alkyl sulphate and alkyl ether sulphate is 0.75–1.25.

4. Composition according to claim 1 which comprises 30–40% wt of alkylpolyglycoside on total surfactant.

5. Composition according to claim 1 wherein the alkylpolyglycoside has an average alkyl chain length of $C_{12-14}$.

6. Composition according to claim 1 wherein more than 50% wt of the alkylpolyglycoside present comprises a $C_{12-14}$ alkylpolyglycoside.

7. Composition according to claim 1 further comprising a hydrotrope wherein the level of hydrotrope is no more than 20% of the total surfactant content on product.

8. Composition according to claim 1 comprising a betaine, an amido betaine or a mixture thereof.

* * * * *